US012663165B1

(12) United States Patent
Nakagawa

(10) Patent No.: US 12,663,165 B1
(45) Date of Patent: Jun. 23, 2026

(54) PROTECTIVE COVER FOR A COOKING APPLIANCE

(71) Applicant: Laurie G. Nakagawa, Sacramento, CA (US)

(72) Inventor: Laurie G. Nakagawa, Sacramento, CA (US)

( * ) Notice: Subject to any disclaimer, the term of this patent is extended or adjusted under 35 U.S.C. 154(b) by 0 days.

(21) Appl. No.: 19/243,153

(22) Filed: Jun. 19, 2025

(51) Int. Cl.
*F24C 15/36* (2006.01)

(52) U.S. Cl.
CPC ..... *F24C 15/36* (2013.01)

(58) Field of Classification Search
CPC ..... F24C 15/36; B23Q 11/0866
See application file for complete search history.

(56) References Cited

U.S. PATENT DOCUMENTS 2,595,833 A * 5/1952 Flaherty ..... B60J 1/2011 160/354
3,043,289 A * 7/1962 Fox ..... F24C 15/36 70/2
4,527,540 A * 7/1985 Ryan ..... F24C 15/36 126/42
4,625,708 A * 12/1986 Beall ..... F24C 15/36 D7/402
4,834,330 A * 5/1989 Swillinger ..... H04N 5/65 248/205.2
4,852,282 A * 8/1989 Selman ..... B43L 1/00 40/776
5,072,979 A * 12/1991 Swinton ..... B60J 11/06 293/128
5,155,627 A * 10/1992 Keehn ..... H04N 5/65 348/E5.131
D346,529 S * 5/1994 Honaker ..... D7/405
D347,550 S * 6/1994 Boone ..... D7/402
5,357,942 A * 10/1994 Williams ..... F24C 7/082 126/299 C
5,438,974 A 8/1995 Maldonado
5,615,667 A * 4/1997 Seeley ..... F24C 15/12 126/211
5,842,464 A 12/1998 Koch
5,984,405 A * 11/1999 Ciacci ..... B60J 7/11 160/354
6,012,445 A * 1/2000 Santelli, Jr. ..... F24C 3/124 126/42
6,371,105 B1 4/2002 Merritt
8,044,942 B1 * 10/2011 Leonhard ..... G06F 3/0393 345/173

(Continued)

*Primary Examiner* — Jorge A Pereiro
(74) *Attorney, Agent, or Firm* — Cramer Patent & Design, PLLC.; Aaron R. Cramer

(57) ABSTRACT

A protective cover for a cooking appliance having a touch-activated control panel is disclosed. The cover includes a rectangular frame with a transparent center section that allows viewing of the control panel while preventing direct contact. Fasteners, such as magnetic strips, adhesive pads, or suction cups, are affixed to an inner side surface of the frame to permit removable attachment to the appliance. The transparent section is preferably made of shatter-proof, heat-resistant material such as Plexiglas®, and may include glare-reducing or UV-resistant coatings. The cover is suitable for vertical or angled control panels and may include optional spacers to maintain a consistent offset. The device serves as a removable barrier to help prevent unintended activation.

1 Claim, 2 Drawing Sheets

(56) References Cited

U.S. PATENT DOCUMENTS

| | | | | |
|---|---|---|---|---|
| 8,416,350 | B2 * | 4/2013 | Tsanev | H04N 5/65 359/461 |
| 10,156,365 | B2 | 12/2018 | Peterson | |
| 10,890,337 | B1 | 1/2021 | Arbogast et al. | |
| 11,346,562 | B1 | 5/2022 | Murdock | |
| 2007/0218247 | A1 * | 9/2007 | Holt | F24C 3/124 428/99 |
| 2008/0163859 | A1 | 7/2008 | Dang | |
| 2008/0285220 | A1 * | 11/2008 | Tai | H05K 5/0204 361/679.02 |
| 2011/0079208 | A1 | 4/2011 | Dang | |
| 2011/0126817 | A1 | 6/2011 | O'Keefe et al. | |
| 2015/0068076 | A1 * | 3/2015 | Knapschaefer | B60R 13/105 40/209 |
| 2017/0242455 | A1 * | 8/2017 | Dickens | A61B 46/10 |
| 2022/0061947 | A1 * | 3/2022 | Porter | A61B 46/10 |
| 2024/0337390 | A1 * | 10/2024 | Karlovich | F24C 3/124 |

* cited by examiner

PROTECTIVE COVER FOR A COOKING APPLIANCE

RELATED APPLICATIONS

Non-applicable.

FIELD OF THE DEVICE

The present device relates generally to the field of safety accessories for household appliances, and more particularly to a protective cover for touch-activated control panels on cooking appliances. The device is designed to prevent accidental or unauthorized activation of control inputs while maintaining clear visual access to the control panel beneath the cover.

BACKGROUND OF THE DEVICE

Touch-sensitive control panels on modern cooking appliances offer a sleek, low-profile design that enables intuitive control and seamless integration into the overall appearance of ovens, ranges, and other kitchen devices. However, the exposed and reactive nature of these panels also presents several drawbacks. Inadvertent activation can occur from accidental brushes during food preparation, cleaning activities, or the curiosity of children. In households with young children, elderly individuals, or persons with cognitive disabilities, unintentional engagement of cooking functions can result in unsafe conditions, including overheating, unattended operation, or changes to preset cooking cycles.

While many appliances include built-in electronic lockout features, these mechanisms often require multiple steps to engage or disengage, and they can be rendered inaccessible or reset during power failures. Additionally, some users may find them non-intuitive or fail to use them consistently. Prior art devices attempting to address this issue are typically permanent, obstructive, or difficult to remove when access to the controls is required. Moreover, these solutions often fail to maintain visibility of the control panel, hindering usability and limiting their adoption. Therefore, a need exists for a removable, transparent, and universally adaptable physical barrier that prevents contact with control panels while allowing the user to view and monitor appliance status. The present device satisfies this long-felt but unresolved need by offering a structurally simple, visually clear, and functionally reliable solution that physically isolates the control panel from contact while enabling easy installation and removal. It accomplishes all of the shortcomings of the prior art in a method and manner that is efficient, cost-effective, and versatile across a range of cooking appliance configurations.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
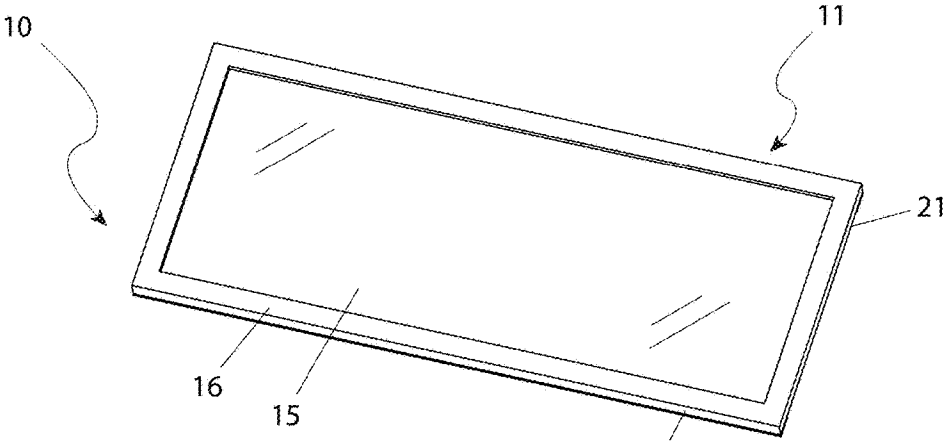
FIG. 1 is a top perspective view of an outer side 11 of a protective cover 10, according to the preferred embodiment of the present device; and, FIG. 2 is a top perspective view of an inner side 12 of the protective cover 10, shown in a utilized state, according to the preferred embodiment of the present device; and, FIG. 3 is a side perspective view of the inner side 12 of the protective cover 10, shown in a utilized state, according to the preferred embodiment of the present device; and, FIG. 4 is an environmental view of the protective cover 10 installed over a control panel 51 of a cooking appliance 50, according to a method of use of the present device.

10 protective cover
11 outer side
12 inner side
15 panel outer side
16 outer side surface
21 edge surface
25 panel inner side
26 inner side surface
30 first fastener
31 second fastener
50 cooking appliance
51 control panel

DESCRIPTION OF THE PREFERRED EMBODIMENTS

The best mode for carrying out the device is presented in terms of its preferred embodiment, herein depicted within FIGS. 1 through 4. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Figure 4:
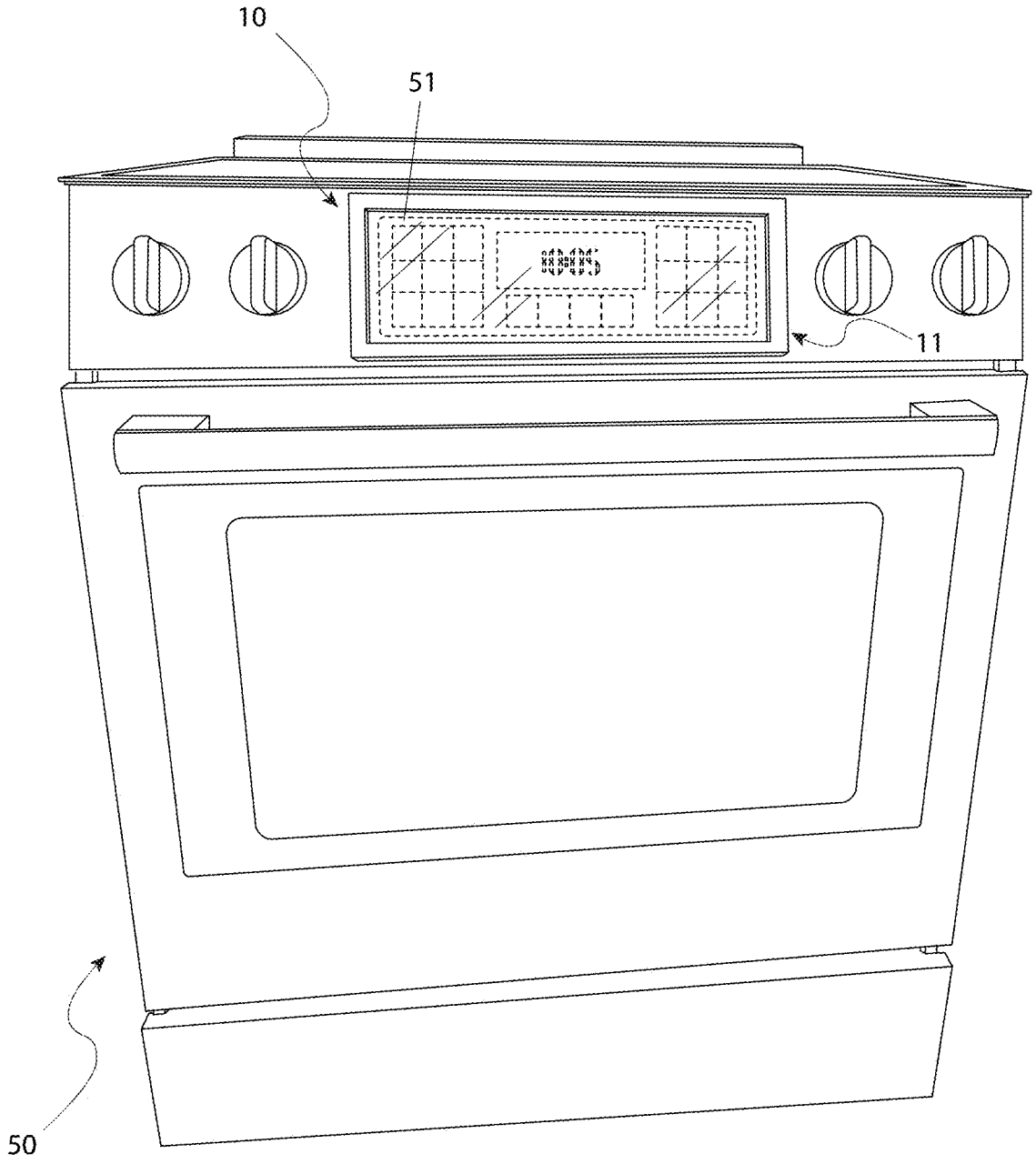

The protective cover 10, when referring to FIG. 4, an environmental view of a protective cover 10, is configured for removable placement over a touch-activated control panel 51 of a cooking appliance 50 and is intended to function as a safety feature therefor. The protective cover 10 is particularly suited for preventing unauthorized or inadvertent contact with the control panel 51. The protective cover 10 is sized to be removably placed over the control panel 51 that is typically present on a vertical and forward-facing surface of the cooking appliance 50. The protective cover 10 may have dimensions to accommodate a one-size-fits-all design or can be customized to accommodate any dimensions of the control panel 51. The protective cover 10 restricts direct physical contact with the control panel 51 and when the outer side 11 of the protective cover 10 is viewed, an unobstructed viewing thereof is permitted.

Figure 2:
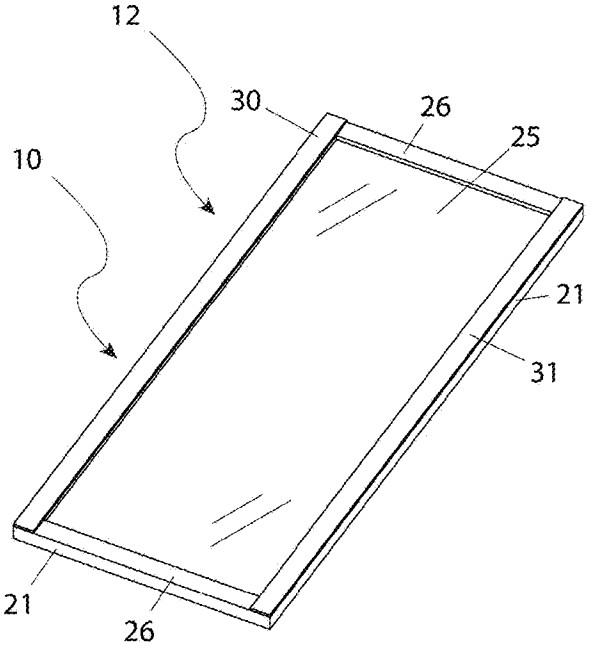
Figure 3:
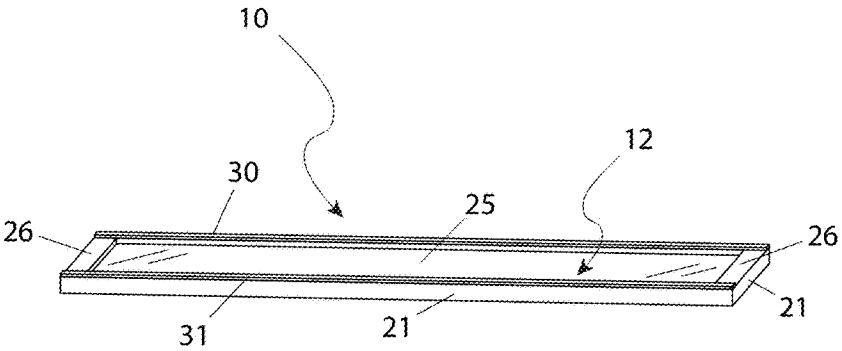

Referring now to FIGS. 1-3, various perspective views of the protective cover 10, are herein described as illustrated. The protective cover 10 is essentially an assembly of disparate elements that combine to provide a unitary construction. The protective cover 10 is defined as having an outer side 11 and an inner side 12. The protective cover 10 comprises joined elements to provide a rectangular frame with an inner transparent center section. The rectangular frame has an inner side surface 16, an outer side surface 26, and an edge surface 21 located on the outer perimeter end of the protective cover 10. In an exemplary embodiment the overall dimensions for the protective cover 10 is five inches (5 in.) in width, thirteen inches (13 in.) in length, and one inch (1 in.) in depth. It is appreciated that the protective cover 10 can be customized to accommodate different sizes and shapes of the cooking appliance 50 and/or control panel 51, and also relative positions of the control panel 51 relative to the cooking appliance 50. This is particularly useful when the cooking appliance 50 is an oven with a forward-facing control panel 50, as illustrated in FIG. 4. In certain embodiments, the rectangular panel can be wood or plastic material.

Affixed, removably attachable, bonded or otherwise coupled to the perimeter inner edge of the rectangular frame is an inner transparent center section, having a panel outer side 15 and a panel inner side 25. The panel outer side 15 and panel inner side 25 may be identical or have different properties or material integrated therewith, embedded therein, bonded thereto, or otherwise incorporating therewith in order to enhance or provide unimpeded viewing of the control panel 51. The inner transparent center section preferably comprises lightweight, shatter-proof, chemically inert, and heat-resistant properties. In an exemplary embodiment, the inner transparent center section is a planar Plexiglas® panel.

A first fastener 30 is affixed, removably attachable, bonded or otherwise coupled to a first portion of the inner side surface 16. A second fastener 31 is affixed, removably attachable, bonded or otherwise coupled to a second portion of the inner side surface 16. The first and second fasteners 30 may work independently or coincidentally to provide a removable attachment means for the protective cover 10 to the cooking appliance 50. In certain embodiments, the first and second portions of the inner side surface 16 are on opposing sides of the rectangular frame to provide a balanced removable attachment means. In an exemplary embodiment, the first fastener 30 and second fasteners 31 are each a magnetic strip such that the removable attachment means is a magnetic attachment to the cooking appliance 50 immediately adjacent the control panel 51. Side spacers may also be provided for attachment to the inner side surface 16 to provide an offset removable attachment means for either or both the first fastener 30 and second fastener 31. Finishing tape may also be removably attached to the inner side surface 16 and/or the second side surface 26.

In an additional embodiment of the protective cover 10, every element disclosed above is retained, including the outer side 11, the inner side 12, the edge surface 21, the inner side surface 16, the outer side surface 26, the panel outer side 15, the panel inner side 25, the first fastener 30, and the second fastener 31. In this embodiment, the protective cover 10 is further configured for use on angled or non-vertical control panels 51 of cooking appliances 50, such as those found on inclined surfaces of countertop cooktops or commercial ranges. The rectangular frame remains consistent in construction and may be fabricated from flexible or semi-rigid materials to enable a conforming engagement with non-planar appliance surfaces. The inner transparent center section remains a planar Plexiglas® panel or equivalent material, but may include integrated UV or glare-reducing coatings to maintain unobstructed viewing in environments with overhead lighting. The first fastener 30 and second fastener 31 may be configured as magnetic strips, adhesive pads, or suction cups, depending on the surface material of the cooking appliance 50. Side spacers or risers may be included to maintain a consistent offset between the control panel 51 and the panel inner side 25, ensuring operability of adjacent components or displays. This embodiment enables the protective cover 10 to be removably attached to a greater variety of cooking appliances 50 while maintaining all safety and visibility benefits of the original design.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A protective cover for a cooking appliance having a touch-activated control panel disposed on a surface of the cooking appliance, the protective cover consisting of:

a rectangular frame consisting of a rigid, semi-rigid, or flexible material, the rectangular frame having: an outer side; an inner side; an edge surface extending continuously around an outer perimeter of the rectangular frame; an inner side surface facing inwardly; and an outer side surface facing outwardly, the rectangular frame being dimensioned to be removably positioned over the touch-activated control panel such that the inner side faces the cooking appliance and the outer side faces away from the cooking appliance;

an inner transparent center section joined to an inner perimeter of the rectangular frame, the inner transparent center section consisting of a single transparent polymeric panel having a panel outer side and a panel inner side, the transparent polymeric panel being configured to permit unobstructed viewing of the touch-activated control panel from the panel outer side while preventing all direct physical contact with the touch-activated control panel;

a first fastener and a second fastener, each fastener being coupled directly to the inner side surface of the rectangular frame on a respective first portion and second portion thereof, the first portion and the second portion being located on opposing sides of the rectangular frame, each of the first fastener and the second fastener consisting of a fastening element selected from the group consisting of: magnetic strips, adhesive pads, and suction cups, the first fastener and the second fastener being configured to removably attach the protective cover to surfaces of the cooking appliance that are adjacent to and outside the perimeter of the touch-activated control panel; and one or more side spacers affixed to the inner side surface of the rectangular frame at a fixed predetermined position, the one or more side spacers being configured to maintain a fixed offset between the panel inner side of the transparent polymeric panel and the touch-activated control panel when the protective cover is installed on the cooking appliance, the fixed offset being sufficient to prevent the transparent polymeric panel from contacting the touch-activated control panel during ordinary use;

wherein the protective cover is configured for removable placement over touch-activated control panels that are vertically oriented, angled, or non-vertical with respect to a horizontal plane of the cooking appliance; and, wherein the rectangular frame, when formed from a flexible or semi-rigid material, is configured to conform to non-planar surfaces of the cooking appliance.

* * * * *